United States Patent [19]

Ott et al.

[11] Patent Number: 4,883,195

[45] Date of Patent: Nov. 28, 1989

[54] PIZZA CONTAINER

[75] Inventors: Edward L. Ott, Smyrna, Ga.; Timothy F. Conway, Riverside; Thomas S. Kubala, Chicago, both of Ill.

[73] Assignee: Restaurant Technology, Inc., Oak Brook, Ill.

[21] Appl. No.: 265,856

[22] Filed: Nov. 2, 1988

[51] Int. Cl.[4] ..... B65D 85/36

[52] U.S. Cl. ..... 220/339; 206/815; 220/366; 229/2.5 R; 426/118

[58] Field of Search ..... 53/453; 220/339, 70, 220/366; 206/541, 545, 557, 815; 229/2.5 R; 426/118, 129

[56] References Cited

U.S. PATENT DOCUMENTS

| | | | |
|---|---|---|---|
| D. 241,109 | 8/1976 | Levin | D7/85 |
| D. 241,820 | 10/1976 | Jewell | D9/3 |
| D. 241,822 | 10/1976 | Jewell . | |
| D. 251,657 | 4/1979 | Jewell | D9/219 |
| D. 254,776 | 4/1980 | Edwards | D9/183 |
| D. 256,097 | 7/1980 | Amberg | D9/219 |
| D. 258,722 | 3/1981 | Commisso et al. | D9/423 |
| D. 259,453 | 6/1981 | Commisso et al. | D9/426 |
| D. 263,684 | 4/1982 | Davis | D9/426 |
| D. 277,167 | 1/1985 | Dart | D9/347 |
| D. 278,412 | 4/1985 | Yeung | D9/420 |
| 642,507 | 1/1900 | Topping . | |
| 3,151,799 | 10/1964 | Engles, Jr. et al. | 229/2.5 R |
| 3,261,530 | 7/1966 | Cave | 229/2.5 |
| 3,335,846 | 8/1967 | Mills | 426/118 |
| 3,346,099 | 10/1967 | Thomas et al. . | |
| 3,436,231 | 4/1969 | Bruce et al. | 99/171 |
| 3,438,507 | 4/1969 | Kreuger | 426/129 |
| 3,464,832 | 9/1969 | Mullinix | 99/171 |
| 3,480,197 | 11/1969 | Massey | 229/43 |
| 3,708,086 | 1/1973 | Colato | 220/20 |
| 3,902,540 | 9/1975 | Commisso . | |
| 3,984,027 | 10/1976 | Smith | 220/306 |
| 4,058,214 | 11/1977 | Mancuso | 206/545 |
| 4,079,880 | 3/1978 | Edwards . | |
| 4,127,189 | 11/1978 | Shumrak et al. | 229/2.5 R |
| 4,132,344 | 1/1979 | Jewell | 229/2.5 R |
| 4,176,744 | 12/1979 | Borzak | 229/2.5 R |
| 4,253,600 | 3/1981 | Schubert | 229/2.5 R |
| 4,373,636 | 2/1983 | Hoffman | 206/551 |
| 4,441,626 | 4/1984 | Hall | 426/118 |
| 4,653,685 | 3/1987 | Leary et al. | 229/2.5 R |

FOREIGN PATENT DOCUMENTS

| | | | |
|---|---|---|---|
| 1075646 | 4/1980 | Canada | 217/12 R |
| 1100424 | 5/1981 | Canada | 190/35 |
| 341347 | 4/1936 | Italy . | |

OTHER PUBLICATIONS

Pizza-Saver TM —Amoco Foam Products Co. (date unknown).

*Primary Examiner*—Jimmy G. Foster
*Attorney, Agent, or Firm*—Jenner & Block

[57] ABSTRACT

A pizza container has a cover and base configured to form a cavity when they are closed. The floor of the base has a plurality of dimples to support a pizza and to allow random air flow. A wall and finger guides are provided to facilitate lifting the pizza from the container. Side and rear vents are provided to the container for facilitating the exchange of air from the interior and the exterior of the container. A plurality of containers are vertically stackable, one on top of another.

22 Claims, 3 Drawing Sheets

FIG. 1
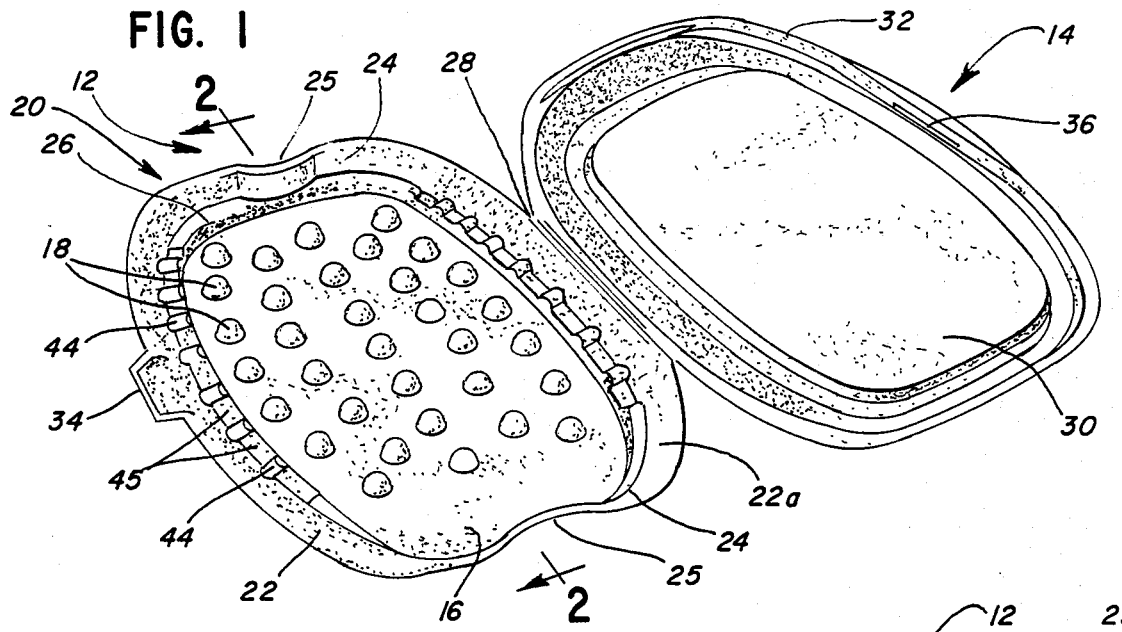
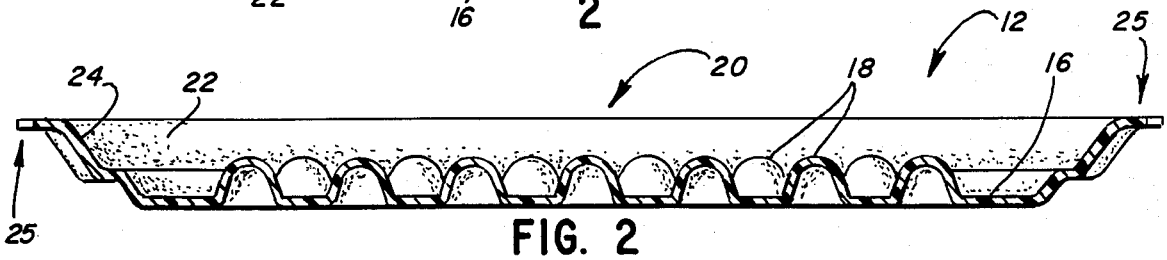
FIG. 2
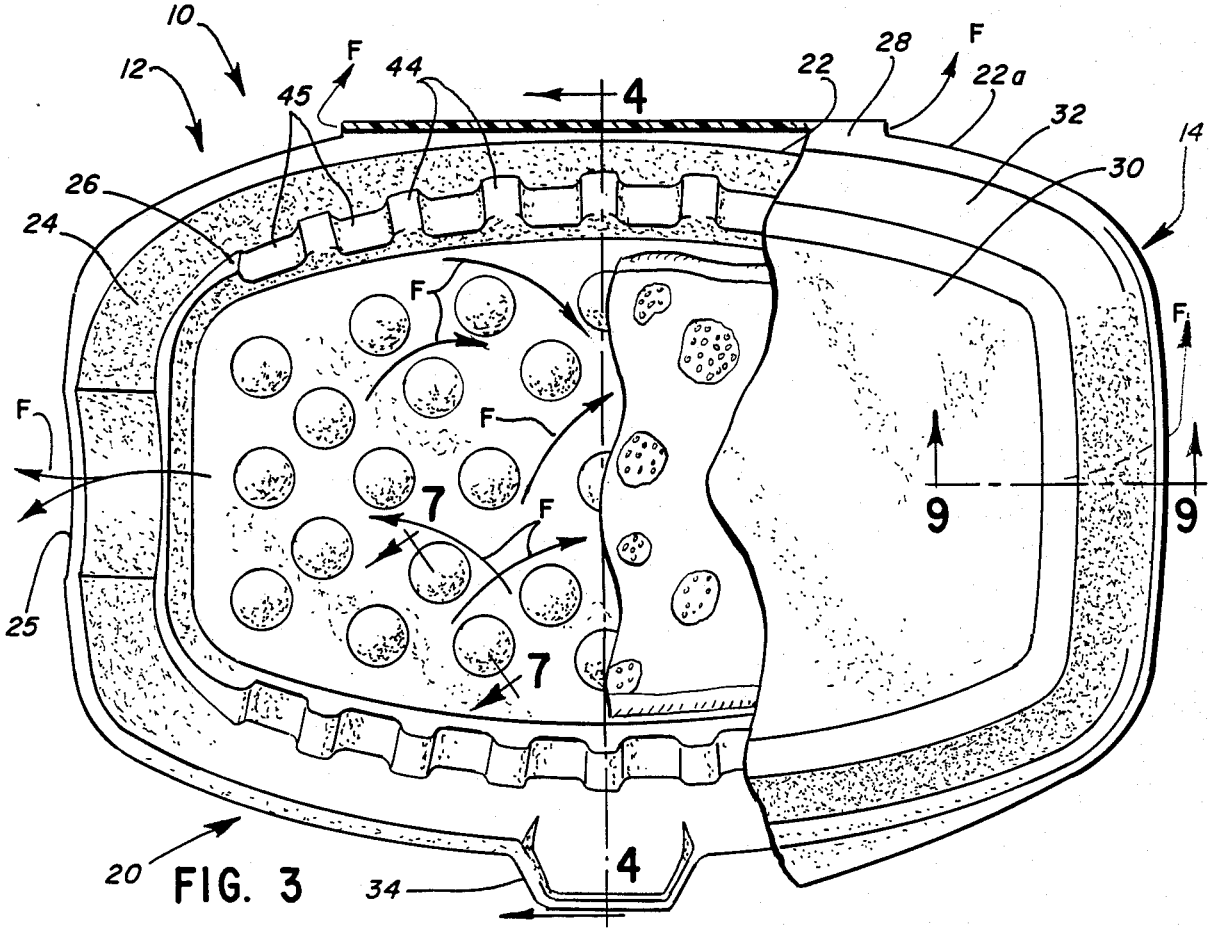
FIG. 3

PIZZA CONTAINER

FIELD OF THE INVENTION

The present invention relates to a container for holding, storing and dispensing food products. More particularly, the container is especially useful for keeping an individual-sized pizza hot, fresh, crisp and tender after cooking but before serving.

BACKGROUND OF THE INVENTION

In many restaurants, particularly quick service restaurants, various food products are typically not served to the customer open on a plate immediately after being cooked. Rather, the food products are placed into individual containers so that each container can be handled, stored, reheated or packaged in a bag, easily and conveniently. After cooking but before being served to the customer, the food products may be held in a holding area for a short period of time. This is especially true when a quick service restaurant prepares a number of food products in anticipation of the traditional busy periods of lunch and dinner.

During this holding period before being served, certain food products can undergo changes in temperature, appearance, texture, and flavor. For example, the edges of hamburgers may get relatively cold and hard, or french fries may soak up vegetable oil which remains on their surfaces after cooking. These changes in appearance tend to decrease customer satisfaction with these food products. The decreased temperature and quality of appearance, texture and flavor makes these food products less appetizing.

It is also known that certain food products, such as pizza, give off latent heat stored in the pizza due to cooking and heating along with moisture or water vapor. At least a portion of this latent heat and moisture can condense on and be reabsorbed by the pizza itself, making the pizza soggy and tough to chew. For example, the water vapor can condense on the surfaces of the container or tray and drip down towards the bottom of the container, where the bottom of the pizza absorbs the condensed water vapor. If air circulation adjacent to and around the pizza is poor, the water reabsorption by the pizza increases-since the latent heat and resultant water vapor is further prevented from circulating away from the pizza. Although a relatively small amount of water vapor escapes from the pizza and condenses, or is prevented from circulating away from the pizza, this amount may be enough to make the pizza become undesirable by being soggy and tough thereby decreasing customer satisfaction. Also, if air from inside the container is not allowed to be exchanged with the air from outside the container, condensation of the water vapor inside the container is more likely.

Food containers that attempt to address the problem of air circulation in the container to help prevent the food product contained therein from absorbing water and becoming soggy have been described in several United States patents. For example, U.S. Pat. No. 4,127,189 to Shumrak et al describes a food container for hamburgers which contains four shamrock-shaped pedestals on its base upon which the hamburger is carried. The pedestals provide for slightly improved air circulation about the hamburger.

In U.S. Pat. No. 4,373,636 to Hoffman, a container is described for a hot pizza pie or slice. The container is provided with a plurality of elongated ribs upon which the pizza is carried. The increased air circulation in the passages defined by and between the elongated ribs, the bottom of the container and the pizza attempts to prevent the pizza from becoming soggy.

Other patents describe ways to exchange air between the interior of the container and the outside air to allow the water vapor to escape. For example, U.S. Pat. No. 3,335,846 describes a container for pizza having a series of venting channels permitting such an exchange. This container has a recessed tray-like base shaped to receive a whole pizza pie and a cover which forms a lid over the base. The cover is provided with one or more openings so that vapors from the interior of the container may be vented to the atmosphere.

Although these techniques may have been useful in helping prevent certain fold products from becoming soggy, an improved container for pizza is desired.

Further, an improved pizza container is needed to prevent the pizza from getting damaged and the consumer's fingers from getting messy when the consumer attempts to lift the pizza out of the container. Specifically, the containers for pizza described above do not allow the consumer to get his or her fingers entirely underneath the pizza for lifting it.

SUMMARY OF THE INVENTION

In accordance with one aspect of the invention, a container is provided for containing pizza that allows air circulation around the bottom, top and edges of a pizza, to prevent the pizza from becoming soggy by preventing moisture from being trapped around the pizza due to condensation of water vapor from the cooling pizza.

This invention involves a container for food products, typically and illustratively a container for pizza, which includes a base and a plurality of raised dimples on the base for supporting the pizza over the base. Supporting the pizza on the dimples promotes increased random air circulation underneath the food. Specifically, the resultant water vapor or moisture and latent heat released from the pizza is allowed to circulate away from the pizza, which reduces and can minimize water vapor from recondensing on the pizza. The bottom section or portion of the container may be fitted with a top section or cover which is attached or attachable to the bottom section.

Preferably, a ridge or elongated boundary circumscribes the plurality of dimples and is offset from the side walls of the bottom section of the container. In the preferred embodiment, the base is depressed outside the elongated boundary. Moreover, finger guides are formed on the two long sections of the elongated boundary. The depression in the base, the finger guides and the elongated boundary cooperate so that a pizza can be easily removed by hand, without implements, without damaging the food and without soiling the fingertips of the consumer.

Further, the bottom section of one container is preferably capable of forming a complementary relationship with the top section of another container for stacking and nesting a number of these containers, such as in a vertical stack, for example.

BRIEF DESCRIPTION OF THE DRAWINGS

FIG. 1 is a perspective view of an open pizza container in accordance with the invention, illustrating the dimples that form part of the container;

FIG. 2 is a cross-sectional view of the container of FIG. 1 along lines 2—2;

FIG. 3 is a fragmentary top view of the FIG. 1 container with the cover closed having a pizza therein;

DETAILED DESCRIPTION OF THE INVENTION

In FIGS. 1-11, containers in accordance with the invention for pizza are generally shown.

Figure 11:
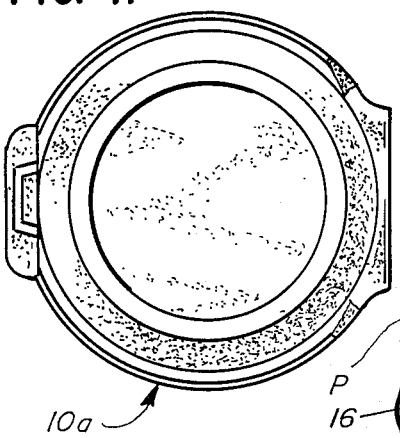
FIG. 11 is a plan view of another embodiment of a pizza container in accordance with the invention.

FIG. 1 shows a container 10 in accordance with the invention. Container 10 can have any desired shape, but is preferably round or oblong. A container 10*a*, similar to container 10 but having a round shape, is illustrated in FIG. 11. As illustrated, container 10 comprises a bottom 12 and a movable cover or top 14 that is hingedly connected to bottom 12. Bottom 12 comprises a base 16 with raised dimples 18 provided on the surface of base 16. Dimples 18 can be integrally formed in base 16 or can be provided on an insert that rests on base 16, as hereinafter described. Dimples 18 also provide structural support for base 16 and are gently rounded so as not to damage or leave significant marks and indentations on the tender bottom crust. A wall 20 extends around the periphery of base 16, comprising a front wall 22, a rear wall 22*a* and a pair of side walls 24. Side walls 24 each have an indentation 25. Further, an elongated boundary 26 is formed along the periphery of base 16 to encircle dimples 18 and is located at positions intermediate dimples 18 and wall 20 and is connected to wall 20. Boundary 26 also assists in collecting any residual water vapor or oil emanating from the product while in the package and being handled or served.

Cover 14 in this embodiment is attached to bottom 12 by a hinge 28. Hinge 28 can be integrally formed of the material of which bottom 12 and cover 14 are formed, as is known in the art. Preferably, hinge 28 provides a slight gap between bottom 12 and cover 14 at the ends of hinge 28 when container 10 is closed, which defines rear vents 29. Cover 14 is capable of pivoting movement about hinge 28 between an open position (as in FIG. 1) and a closed position (as in FIG. 3) to define an enclosed chamber 37 for containing pizza P. Cover 14 has a central portion 30 and a downwardly extending wall 32 formed along the periphery of central portion 30. Cover 14 is capable of being temporarily coupled to bottom 12 by allowing a projecting tab 34 on bottom 12 to pass through a complementary slot 36 on cover 14. Hinge 28 also can allow air circulation into and out of container 10.

Figure 4:
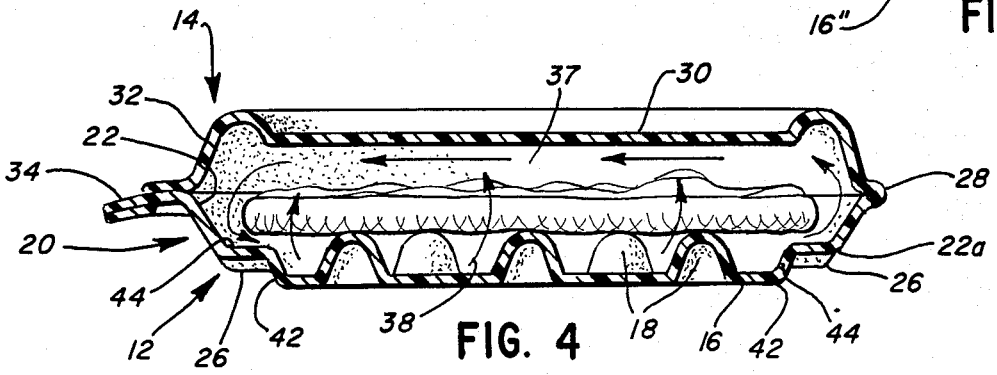
FIG. 4 is a cross-sectional view of the container in FIG. 3 along lines 4—4 and illustrates air flow to, from and in the container.

As seen in FIGS. 3-4, pizza P is supported by dimples 18, creating an airspace or cavity 38 in enclosed chamber 37 between the pizza P and base 16.

Figure 8:
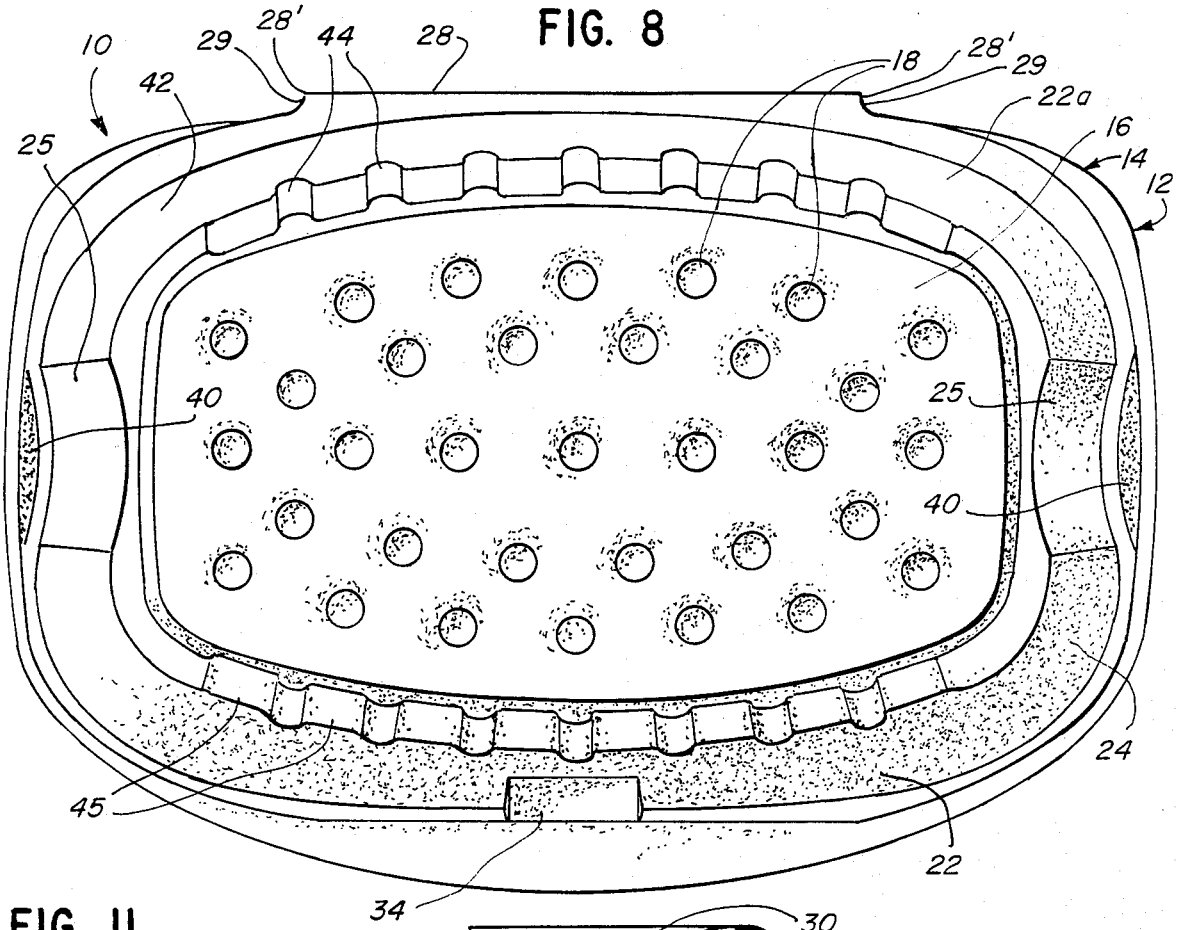
FIG. 8 is a bottom view of the container in FIG. 4 illustrating the side vents of the container.
Figure 9:
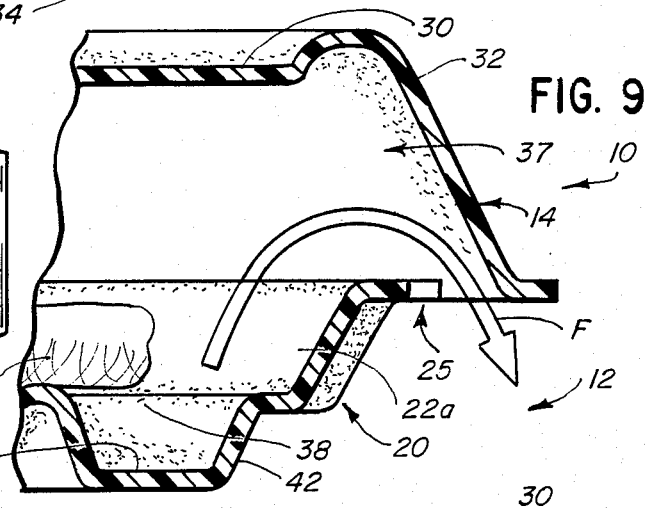
FIG. 9 is an enlarged, sectional side view of the container of FIG. 1 with the cover closed along the lines 9—9 of FIG. 3, illustrating an exchange of air between the interior and exterior of the container.

Also shown in FIGS. 3-4 are possible random air flows represented by single or double ended arrows F and are depicted for illustrative purposes. These air flows circulate in random fashion in, out and around airspace 38 and the remainder of enclosed chamber 37. Arrows F also represent some of the latent heat and vapors emanating from pizza P, which include water vapor. Since pizza P is supported above base 16, these vapors escape in all directions from pizza P and create air flows in chamber 37. There air flows pass to the sides of pizza P and can at least partially travel out of chamber 37, as shown in FIG. 3. Air containing relatively little water vapor is allowed to pass into chamber 37, thereby further facilitating the passage of air containing water vapor away from pizza P. As illustrated in FIGS. 8 and 9, the air inside container 10 is capable of being exchanged with air outside container 10 through side vents 40 and rear hinge vents 29.

The structure of container 10 provides vents permitting the water-vapor laden air to be exchanged for air with relatively lower moisture and latent heat, to assist in preventing recondensation of water vapor on pizza P. Specifically, a side vent 40 is formed by the cooperation of each of indentation 25 of bottom 12 and cover 14 when container 10 is closed. Rear vents 29 are formed at the ends 28', of hinge 28, as previously described.

In actuality, any combination of air flow within airspace 38 is possible.

Figure 12:
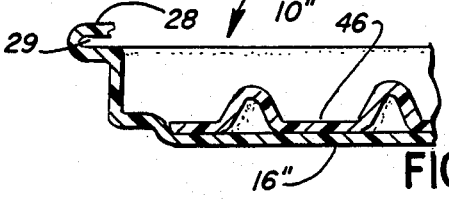
FIG. 12 is a side, cross-sectional view illustrating a dimpled insert placed over a base.

Container 10 is made of desired materials, such as foamed polymer material (formed polyethylene, for example), solid plastic, paper cardboard, or edible material. Bottom 12 and cover 14 can be made of different material. For example, bottom 12 can be made of solid plastic and cover 14 can be made of cardboard or some other material. Dimples 18 can be formed at the same time as bottom 12 is formed As illustrated in FIG. 1, dimples 18 are integrally formed in base 16. Alternatively, as illustrated in FIG. 12, a container 10" which is similar to container 10 (except for base 16") has a dimpled insert 46 which is placed over base 16". Base 16" is essentially identical to base 16 except that base 16" is flat and has no dimples. Dimpled insert 46 is appropriately dimensioned to provide the desired dimple support as for container 10. Hinge vent 29 is also illustrated in FIG. 12.

Figure 10:
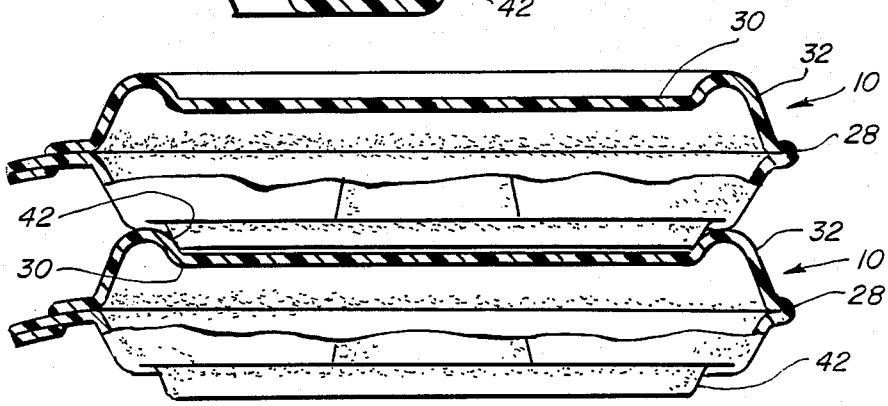
FIG. 10 is a side, cross-sectional view of two containers as in FIG. 1 stacked one on top of the other.

A plurality of containers 10 are vertically stackable, or nestable, one on top of another, as shown in FIG. 10. Bottom 12 of a container 10 has a downwardly tapered portion 42 which is complementary to cover 14, nesting on central portion 30 within wall 32. Nesting of containers 10 allows for a plurality of cooked pizzas P to be individually placed in separate containers 10, stacked and held before being served. Wall 32 cooperates with tapered portion 42 to permit easy nesting and stacking. Further, nesting of containers 10 in a vertical stack allows a plurality of pizzas P to be efficiently packaged for customers, such as placing the stacked containers in a bag.

Figure 5:
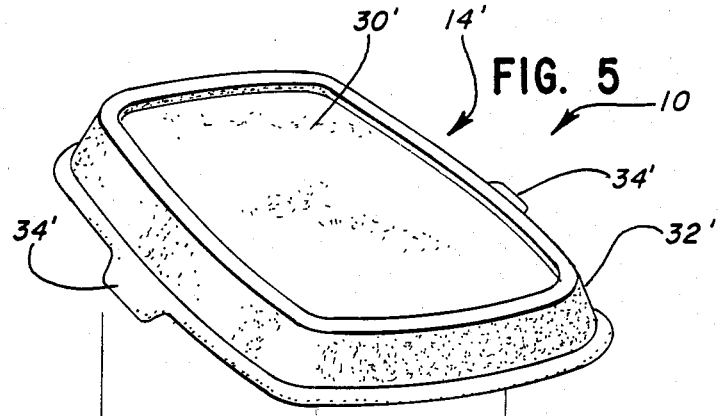
FIG. 5 is an exploded view of another embodiment of the invention wherein the cover is removable from the bottom section.

FIG. 5 shows another embodiment of the invention, in which bottom 12', has removable cover 14'. Pizza P may be placed on dimples 18 and removable cover 14', is mounted on bottom 12 to define a chamber for pizza P. Removable cover 14', is mounted to bottom 12', by allowing a pair of projecting tabs 34', each on opposite ends of container 10', to pass through dual cooperating slots 36'.

Figure 6:
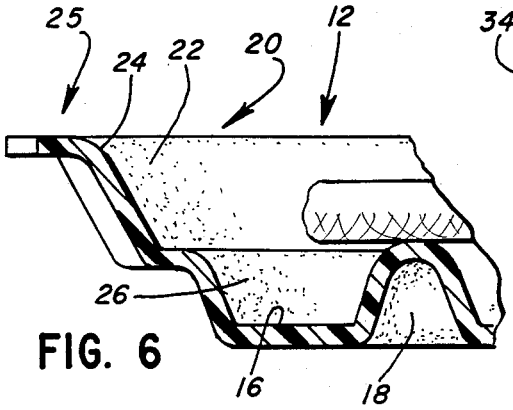
FIG. 6 is an enlarged sectional side view of a portion of the elongated boundary of the container of FIG. 1.

The construction and placement of dimples 18 is shown enlarged in FIG. 6. Dimension h shows the height of each dimple; dimension 1 shows the approximate spacing between the centers of dimples 18. Although the exact size and spacing in accordance with this invention may vary, the preferred size and spacing of the dimples 18 is of a height "h" of 0.25 (one quarter) inches and the approximate spacing "1" between adjacent dimples to be in the range of 0.5 (one-half) inches to 0.875 (seven-eighths) inches.

Figure 7:
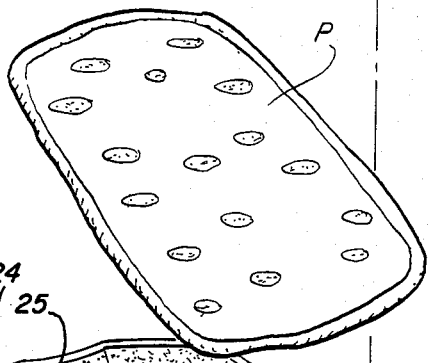
FIG. 7 is an enlarged fragmentary view of two of the dimples along lines 7—7 of FIG. 3.
Figure 7:
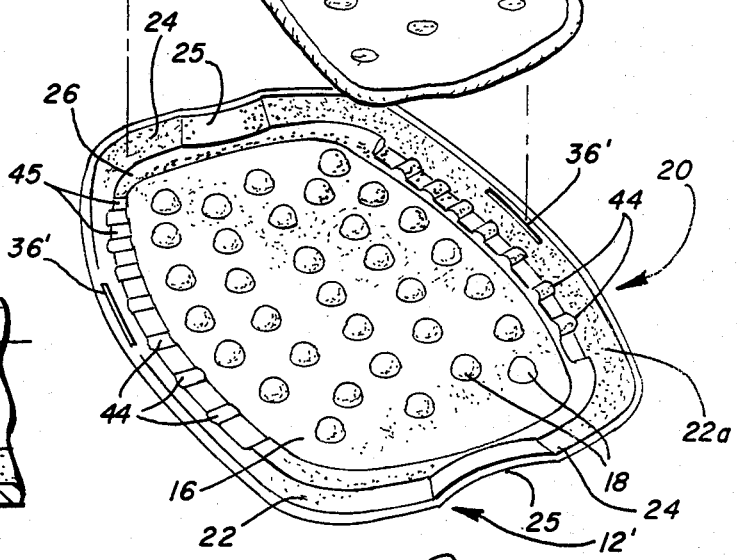
Figure 7:
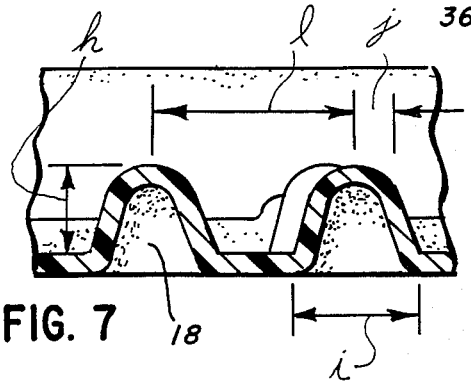

Similarly, the shape of the dimples in accordance with this invention may vary. However, the preferred shape of dimples 18 is a rounded, cone-like shape. Specifically, the base of dimples 18 is circular, with dimple 18 extending upward with a decreasing radius. Dimensions "i" and "j" in FIG. 7 represent the radius of the dimples 18 at their base and their top, respectively. The preferred values of dimensions i and j are three-sixteenths inches and one-sixteenth inches, respectively.

FIG. 6 shows an enlarged view of elongated boundary 26. Pizza P is located if necessary on elongated boundary 26 and to overhang a portion of airspace 38. Elongated boundary 26 further has disposed along its length a plurality of raised ribs 44 that provide structural integrity and further act as finger guides. Ribs 44 are essentially indentations on the bottom of elongated boundary 26 extending adjacent and normal to front and rear walls 22 and **22*a*, respectively. Ribs 44 have a width sufficient to accommodate the tip of an average consumer's fingertips, illustratively a width of 0.375 (three-eighths) inches. Airspace 38, in conjunction with elongated boundary 26 facilitates lifting of pizza P by allowing the consumer's fingers to easily get underneath pizza P. As shown, the consumer does not have to push the pizza P inward in order to get underneath it preventing the pizza from getting damaged. The consumer first places his or her fingers in the space provided between pizza P and wall 20. The consumer's fingertips are then maneuvered underneath pizza P and inward towards the center of the pizza P. The consumer's fingertips may then meet ribs 44 and are guided upwards until pizza P is contacted. The consumer is thus easily able to lift pizza P out of container 10**. Consumer satisfaction is thereby increased since the consumer's fingers may become less soiled and the pizza may become less damaged.

Indentations 25 of side walls 24 also serve to guide the consumer's fingertips underneath pizza P and inward towards the center of pizza P.

In describing various embodiments herein, the portions of the container are sometimes referred to as bottom or top. It is to be understood that such relative positions can be reversed or can be otherwise described and the particular orientations utilized are not to be construed as limitations on the invention.

While the invention has been described in connection with two preferred embodiments, it will be understood that discussion was not intended to limit the invention to these embodiments. On the contrary, it is intended to cover all alternatives, modifications and equivalents as may be included in the spirit and scope of the invention as defined by the appended claims.

What is claimed is:

1. A container suitable for containing pizza comprising:

(a) a base;

(b) a plurality of raised dimples on said base for supporting said pizza thereon while defining a cavity for air flow between said pizza and said base;

(c) an upwardly extending wall formed along the periphery of said base;

(d) a cover capable of removably coupling to said wall to define a chamber for containing pizza, a portion of the bottom edge of said cover extending outward from and not contacting said wall to form a vent for the exchange of air between said chamber and the exterior of the container; and (e) said base including a raised elongated boundary enclosing said dimples, said base further including a depression along at least a portion of said elongated boundary on the said opposite said dimples.

2. The container according to claim 1 wherein said dimples are spaced apart from each other in the range of one-half inches to seven-eighths inches apart.

3. The container according to claim 1 wherein said dimples have a height of approximately two-eighths inches.

4. The container according to claim 1 wherein said dimples have a radius at the base of approximately three-sixteenths inches.

5. The container according to claim 4 wherein said dimples have a radius at the top of approximately one-sixteenth inches.

6. The container according to claim 1 wherein said base and dimples are made up of material selected from the group consisting of foam plastic or solid plastic.

7. The container according to claim 1 wherein said container is of oblong shape.

8. The container according to claim 1 wherein said container is of circular shape.

9. A container for pizza comprising:

(a) a base;

(b) a plurality of raised dimples on said base for supporting pizza thereon while defining a cavity for air flow between the pizza and said base, said dimples being spaced apart from each other in the range of one-half to seven-eighths inches apart;

(c) a wall along the periphery of said base;

(d) a cover attached to said wall by a hinge for movement between an open position and a closed position, said cover being mounted on said wall in said closed position to define a chamber for containing the pizza; and (e) said base including a raised elongated boundary encircling said dimples, said elongated boundary provided with a plurality of finger guides.

10. The container according to claim 9 wherein said hinge is integrally formed from said wall and cover and defines at least one vent in said container when said cover is closed.

11. The container according to claim 9 wherein said dimples have a radius at the base of approximately three-sixteenths inches.

12. The container according to claim 9 wherein said dimples have a radius at the top of approximately one-sixteenth inches.

13. The container according to claim 9 wherein said base and dimples are made of a material selected from the group consisting of foamed plastic, solid plastic, paper or edible material.

14. The container according to claim 9 wherein said container is of oblong shape.

15. The container according to claim 9 wherein said container is of circular shape.

16. The container according to claim 9 wherein said base contains a depression along at least a portion of said elongated boundary on the side opposite said dimples for facilitating removal of the pizza from said container.

17. A container for food comprising:

(a) a bottom including a base;

(b) support means on said base for supporting the food above the base while defining a cavity between the food and said base; and (c) finger guides also located on said base for guiding a person's fingers between the food and said base; and (d) an elongated, raised boundary on said base surrounding said support means, said finger guides forming part of said boundary.

18. The container of claim 17 wherein said base contains a depression along at least a portion of said base on the side of said elongated boundary opposite said support means.

19. The container of claim 17 wherein said support means comprises a plurality of raised dimples.

20. The container of claim 17 further comprising a cover connected to said bottom by hinge means.

21. The container of claim 20 wherein said hinge means defines at least one vent in said container when said cover is closed.

22. A container suitable for containing pizza comprising:

(a base;

(b) a plurality of raised dimples on said base for supporting said pizza thereon while defining a cavity for air flow between said pizza and said base;

(c) an upwardly extending wall formed along the periphery of said base; and (d) a cover capable of removably coupling to said wall to define a chamber for containing pizza, a portion of the bottom edge of said cover extending outward from and not contacting said wall to form a vent for the exchange of air between said chamber and the exterior of the container; and (e) said base including a raised elongated boundary enclosing said dimples, wherein said elongated boundary is provided with a plurality of finger guides formed in said elongated boundary.

* * * * *

UNITED STATES PATENT AND TRADEMARK OFFICE

CERTIFICATE OF CORRECTION

PATENT NO. : 4,883,195

DATED : November 28, 1989

INVENTOR(S) : Edward L. Ott, et al.

It is certified that error appears in the above-identified patent and that said Letters Patent is hereby corrected as shown below:

Title page, item [56], under "References Cited" after "4,058,214 11/1977 Mancuso", delete "206/545" and insert therefor --220/2.5R--.

Col. 1, line 45, delete "increases-since" and insert therefor --increases since--.

Col. 3, line 4, after "closed" insert a comma --,--.

Col. 4, line 30, delete "indentation" and insert therefor --indentations--;

line 32, after "28'", delete the comma ","

line 37, after "paper" insert a comma --,--;

line 42, after "formed" insert a period --.--;

line 67, after "14'" delete the comma ","; and line 68, delete "12" and insert therefor --12'--.

Col. 5, line 1, after "12'" delete the comma ",";

line 6, delete "6" and insert therefor --7--;

line 28, after "44" insert --(FIGS. 1 and 3); and line 40, after "it" insert a comma --,--.

UNITED STATES PATENT AND TRADEMARK OFFICE

CERTIFICATE OF CORRECTION

PATENT NO. : 4,883,195

DATED : November 28, 1989

INVENTOR(S) : Edward L. Ott, et al.

It is certified that error appears in the above-identified patent and that said Letters Patent is hereby corrected as shown below:

Col. 6, line 18, delete "said" (first occurrence) and insert therefor --side--;

line 62, delete "9" and insert therefor --11--.

Col. 8, line 10, delete "(a" and insert therefor --(a)--; and line 15, delete "and".

Signed and Sealed this

Third Day of August, 1993

Michael K. Kirk

MICHAEL K. KIRK

*Acting Commissioner of Patents and Trademarks*

*Attest:*

*Attesting Officer*